US006279891B1

(12) United States Patent
Jaeger

(10) Patent No.: US 6,279,891 B1
(45) Date of Patent: Aug. 28, 2001

(54) MODULAR PROCESSING LINE FOR PRINTED PRODUCTS

(75) Inventor: Erich Jaeger, Frauenfeld (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/367,939

(22) PCT Filed: Jan. 20, 1998

(86) PCT No.: PCT/CH98/00016

§ 371 Date: Aug. 17, 1999

§ 102(e) Date: Aug. 17, 1999

(87) PCT Pub. No.: WO98/37003

PCT Pub. Date: Aug. 27, 1998

(30) Foreign Application Priority Data

Feb. 18, 1997 (CH) ..... 366/97

(51) Int. Cl.[7] ..... B65H 39/055; B65H 39/075

(52) U.S. Cl. ..... 270/58.01; 270/52.14; 270/52.16

(58) Field of Search ..... 198/583, 584, 198/644, 860.2; 270/52.01, 52.14, 52.16, 52.18, 52.29, 58.01, 58.07, 58.08, 58.26

(56) References Cited

U.S. PATENT DOCUMENTS

| | | | | |
|---|---|---|---|---|
| 1,441,278 | | 1/1923 | Halvorsen . | |
| 4,349,189 | * | 9/1982 | Edstrom | 198/583 X |
| 4,726,461 | * | 2/1988 | Pokrinchak | 198/583 X |
| 4,881,633 | * | 11/1989 | Cailey et al. | 198/860.2 X |
| 5,074,678 | | 12/1991 | Eberle . | |
| 5,116,033 | | 5/1992 | Honegger . | |
| 5,125,140 | * | 6/1992 | Sticht | 198/860.2 X |
| 5,158,277 | | 10/1992 | Reist . | |
| 5,191,540 | * | 3/1993 | Ramsey | 270/58.01 X |
| 5,592,881 | * | 1/1997 | Rabjohns | 270/58.01 X |
| 5,609,238 | * | 3/1997 | Christensen | 198/583 |
| 5,810,346 | * | 9/1998 | Jorg | 270/58.07 X |
| 5,884,746 | * | 3/1999 | Leisner et al. | 198/583 X |
| 5,904,242 | * | 5/1999 | Swanson | 198/860.2 |

FOREIGN PATENT DOCUMENTS

| | | |
|---|---|---|
| WO 96/04195 | 2/1996 | (WO) . |
| WO 98/35901 | 8/1998 | (WO) . |

* cited by examiner

*Primary Examiner*—Christopher P. Ellis
*Assistant Examiner*—Patrick Mackey
(74) *Attorney, Agent, or Firm*—Alston & Bird LLP

(57) ABSTRACT

A processing line for printed products 18 which comprises a number of component modules 10, 12, 14, 34, 36, 46 which are arranged directly one behind the other in the direction of processing V. The printed products are supplied to the line at sequential locations so that the products are processing and/or combined to form intermediate or end products which are delivered to a removal location. The printed products are conveyed along the processing line by a conveyor 20, 20'. The component modules can be separated from one another, and the conveyor is composed of conveying elements 98 which can be separated when the component modules are separated such that at least one conveying element remains in each of the component modules.

12 Claims, 5 Drawing Sheets

Fig.5
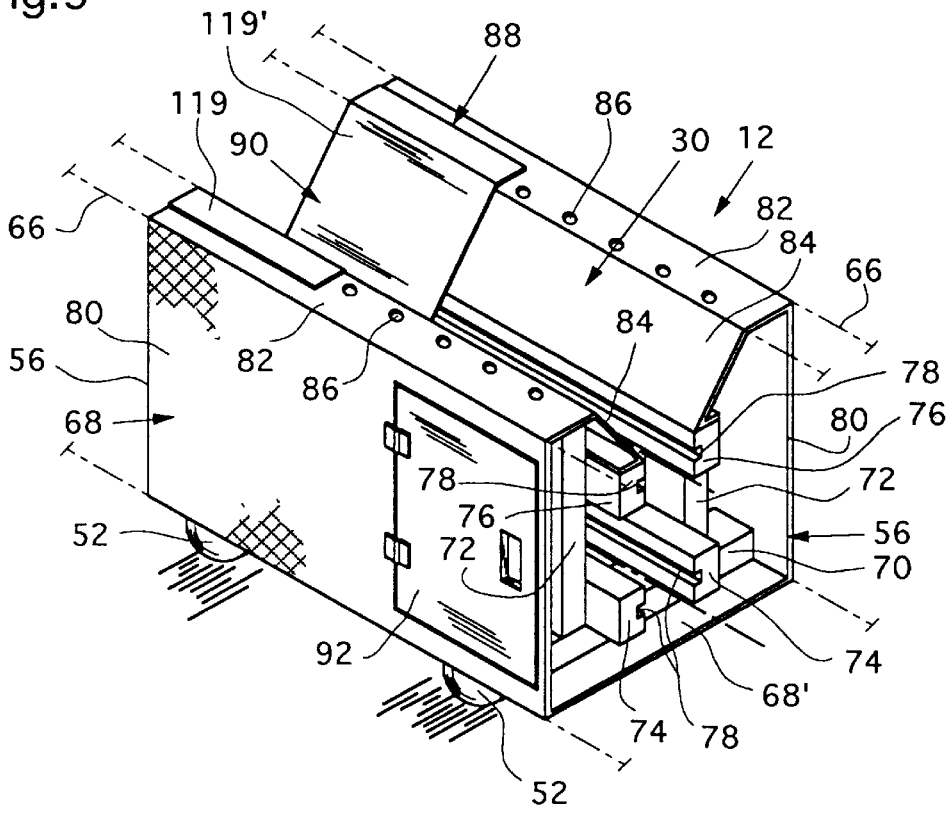
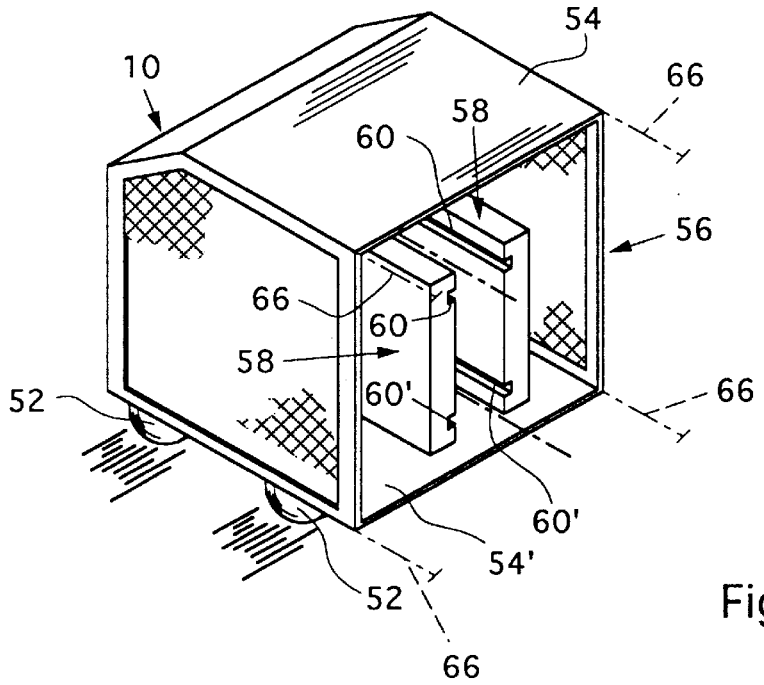
Fig.4

Fig.6
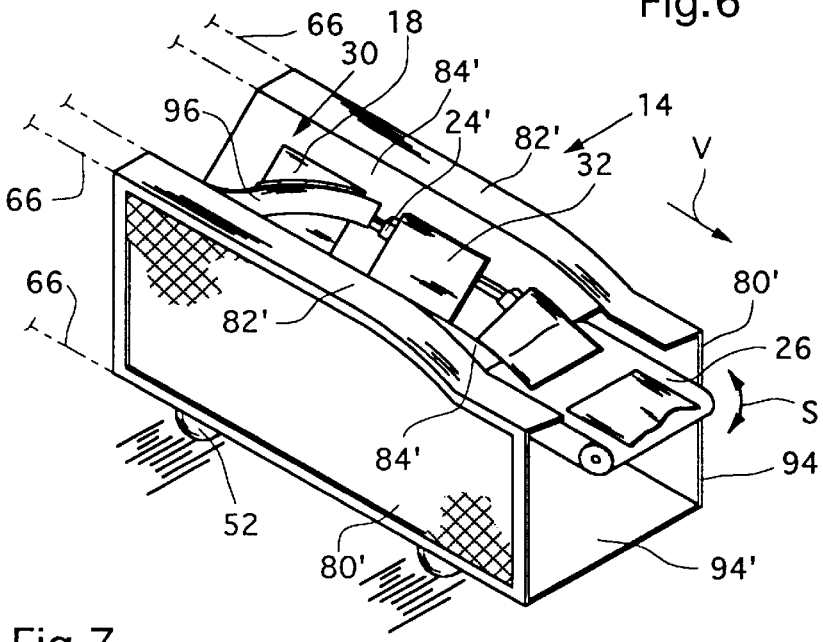
Fig.7
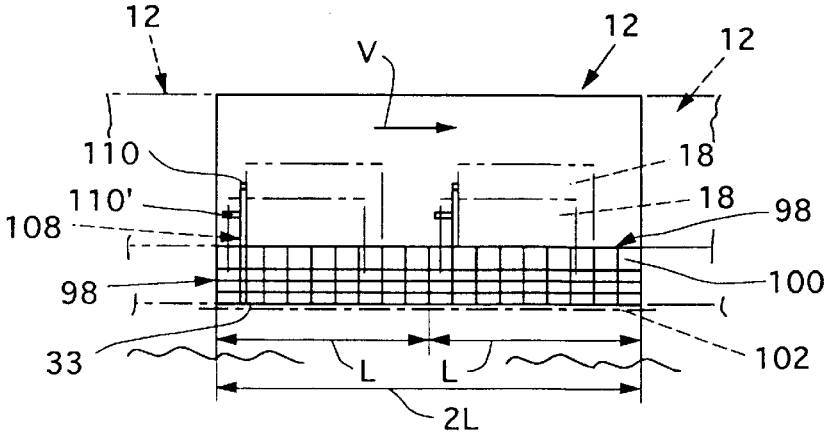
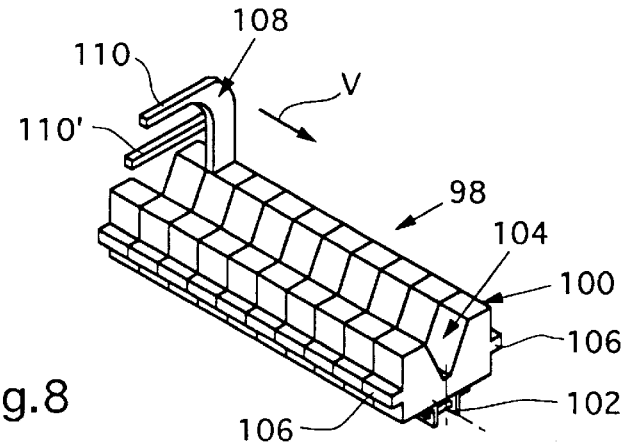
Fig.8

Fig.11
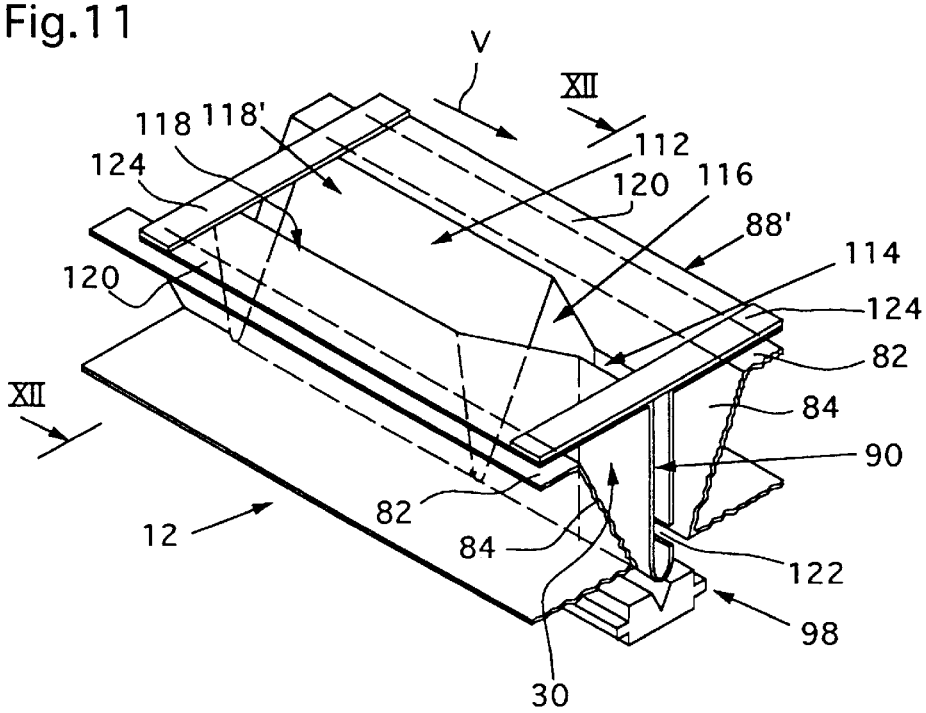
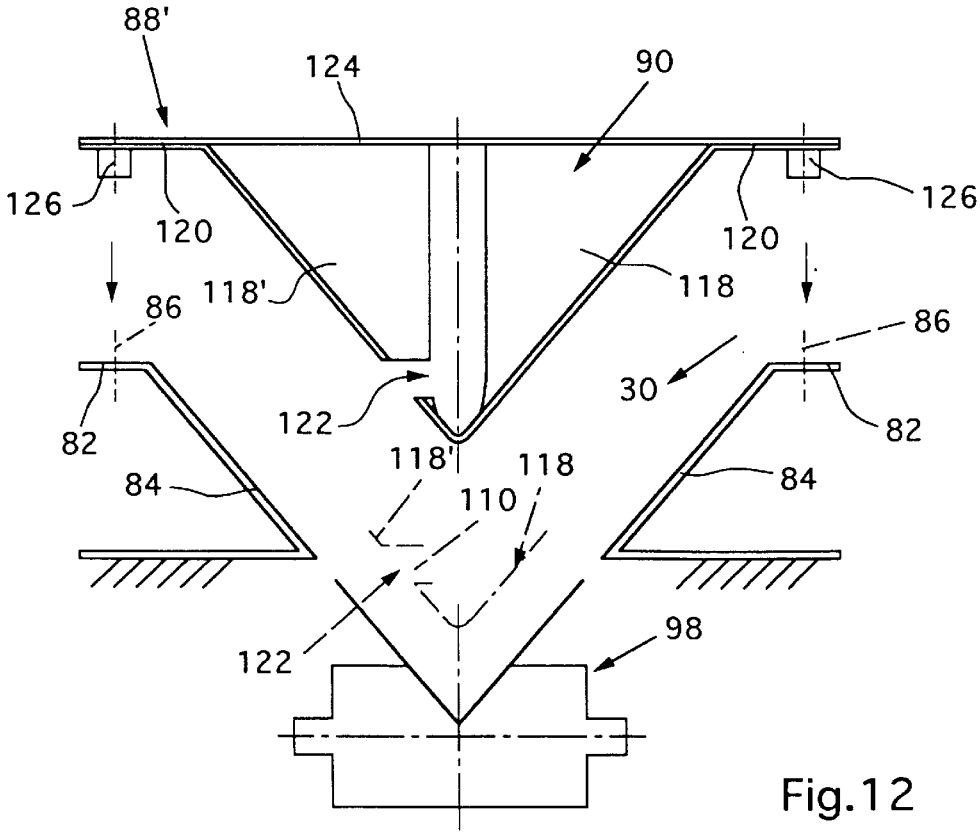
Fig.12

MODULAR PROCESSING LINE FOR PRINTED PRODUCTS

BACKGROUND OF THE INVENTION:

The present invention relates to a processing line for printed products.

A processing line of this type is known, for example, from EP-A-0 346 579 and the corresponding U.S. Pat. No. 5,116,033. The processing line, which is suitable for the collection, collation and insertion of printed products, has a plurality of supply locations, which are arranged one behind the other, as seen in the processing direction, and a removal location, which is arranged downstream of said supply locations. Running through the entire processing line, which is designed as a structural unit, is a conveying chain which is driven in circulation in the processing direction and serves for transporting to the removal location the printed products supplied.

Said known apparatus has a certain number of supply locations. If the number of printed products which is to be combined is smaller than the number of supply locations, the supply locations which are not required are not supplied with printed products; the relevant section of the processing line remains inactive and serves solely for transporting the printed products supplied upstream. It is not possible to combine a number of different printed products which is greater than the number of supply locations.

The same applies to the processing line which is known from U.S. Pat. No. 1,441,278. This processing line has a rectilinear processing channel which is open at the top and along which feeders are arranged one behind the other on both sides, a first feeder introducing a folded printed product into the processing channel and said printed product then being opened in the processing channel. The next-following feeders then introduce further printed products into the open printed product. The printed products are transported in the processing channel by means of an uninterrupted chain conveyor which extends over the entire length of the processing channel. The chain conveyor has transporting webs which engage through the processing channel and are fastened at both ends on an endless chain in each case. The active strand of these chains is guided in the appropriate, processing-channel-forming side wall, and the return strand runs beneath the processing channel.

It is thus an object of the present invention to develop the processing line of the generic type such that it provides high flexibility for different possible applications.

SUMMARY OF THE INVENTION

This object is achieved by a processing line which has the features of claim 1.

The processing line according to the invention is of modular construction and, consequently, extremely flexible and can be adapted to the respectively desired processing operation for the printed products. The component modules which are not necessary for carrying out a certain operation can be removed from the processing line and are available as a reserve component module or for temporary use in a further processing line. It is also possible, if further processing operations are desired, for corresponding component modules to be installed in the processing line. Adjacent component modules are compatible for connection to one another. It is advantageous for all the component modules to have the same connection configuration on the inlet and outlet sides, although this is not absolutely necessary. Component modules with the same connection configuration on both sides can be exchanged as desired and inserted between component modules of corresponding connection configuration.

At least two of the component modules are assigned a continuous conveyor for transporting the printed products. When these component modules are separated, the conveyor may also be separated, with the result that a section of the conveyor remains in each of the component modules. This conveyor is functional when component modules with appropriate sections are attached to one another. The conveyor is realized in its entirety only when the appropriate component modules are assembled.

BRIEF DESCRIPTION OF THE DRAWINGS

The present subject matter of the invention, then, is described in more detail with reference to exemplary embodiments illustrated in the drawing, in which, purely schematically:

FIG. 4 shows a perspective illustration of a drive module for processing lines according to the invention;

FIG. 5 shows a perspective illustration of a multipurpose module with a plug-on attachment;

FIG. 6 shows a perspective illustration of a removal module;

FIG. 7 shows a vertical longitudinal section of a multipurpose module with conveying elements for transporting printed products;

FIG. 8 shows a perspective illustration of a conveying element;

FIG. 11 shows a perspective illustration of part of the multipurpose module shown in FIG. 5, said module having a differently designed plug-on attachment; and FIG. 12 shows, in a section along line XII—XII of FIG. 11, that part of the multipurpose module and of the plug-on attachment which is shown in FIG. 11, it being possible for said plug-on attachment to be inserted into the conveying channel of the multipurpose module in the arrow direction.

DETAILED DESCRIPTION OF THE PREFERRED EMBODIMENTS

Figure 1:
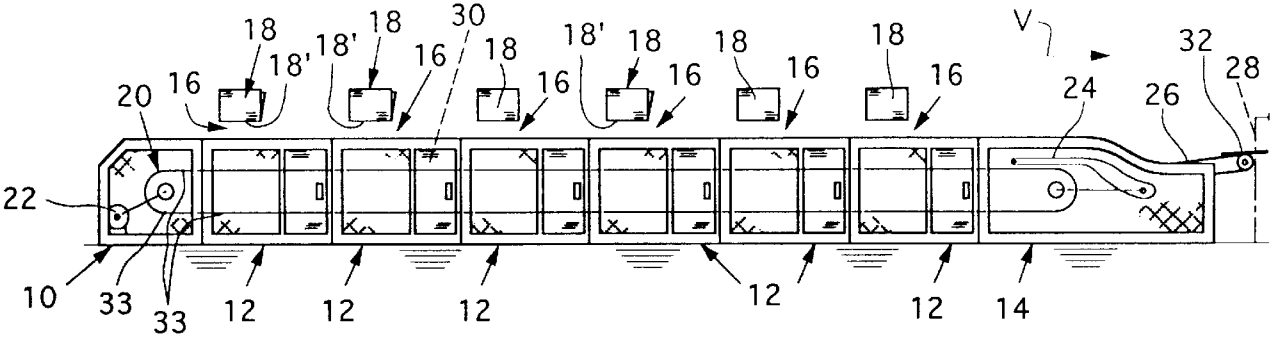
FIG. 1 shows a view of a first embodiment of a processing line according to the invention.

The processing line which is shown in FIG. 1 has, directly one behind the other in the processing direction V, a drive module 10, six multipurpose modules 12 and a removal module 14. Each of the multipurpose modules 12 is assigned a supply location 16, at which printed products 18 are supplied one after the other to the relevant multipurpose module 12; the supply operation taking place, for example, by means of generally known transporters, feeders, feeder stations or other known supply means.

Extending continuously through all the multipurpose modules 12 from the drive module 10 to the removal module 14 is a conveyor 20, which is intended for conveying in the processing direction V the printed products 18 which are supplied to the multipurpose modules 12. A drive unit 22, which is designed as an electric motor and is intended for driving the conveyor 20, is arranged in the drive module 10. In the removal module 14, the movement of the conveyor 20 is picked up and used for driving a conveying-protrusion chain 24 and a delivery belt 26, which is intended for supplying to a downstream processing station 28 the printed products 18 which are processed in the processing line. The conveying-protrusion chain 24 serves for transporting the printed products 18 from the conveyor 20 to the delivery belt 26, as is described in more detail hereinbelow.

The multipurpose modules 12, which are of identical construction, form a continuous conveying channel 30 which, in the case of the present example, runs rectilinearly in the processing direction V and is open at the top. Plugged on to each multipurpose module is an attachment, which will be described at a later stage in the text, forms a processing channel, which is arranged above the conveying channel 30, and is designed in accordance with the function which is to be fulfilled. At the supply locations 16, the printed products 18 are introduced into the relevant processing channel, appropriately processed, for example, opened, closed or tilted onto a certain side, and then supplied to the conveying channel 30. The printed products 18 are transported in the processing channel and in the conveying channel 30 by means of the conveyor 20.

As it is transported, a folded printed product 18 which is respectively supplied to the attachment of the first multipurpose module 12, as seen in the processing direction V, with the fold 18'in front is opened, transferred to the conveying channel 30 and conveyed to the next-following, second multipurpose module 12. A further folded printed product 18, which is respectively supplied to the attachment of said second multipurpose module 12 with the fold 18' in front is likewise opened and, upon transfer onto the conveying channel 30, comes to rest in the previously opened printed product 18. These printed products 18 inserted one inside the other are supplied to the third multipurpose module 12. A printed product 18 which is supplied to the attachment of the third multipurpose module 12 is transferred to the conveying channel 30 in an unopened state and inserted into the open printed products 18 already located there. The three printed products 18 inserted one inside the other are supplied to the fourth multipurpose module 12, where, in the same manner as with the second multipurpose module 12, a further folded printed product 18, which is opened in the attachment, is added. In the case of the two next-following multipurpose modules 12, in each case one further printed product 18 is inserted into said further folded printed product 18, as with the third multipurpose module 12. In the removal module 14, the printed products 18 which have been combined to form finished or intermediate products 32 by insertion are closed and positioned against a side wall of the conveying channel 30. The conveying-protrusion chain 24 then transports to the delivery belt 26 the finished or intermediate products 32 butting against said side wall.

Since all the multipurpose modules 12 are of identical design and the conveyor 20 is designed such that it can likewise be separated when two component modules are separated, with the result that a section 33 of the conveyor 20 remains in each of these component modules, it is possible for multipurpose modules 12 to be separated out of the processing line or for further multipurpose modules 12 to be inserted at the desired location between two modules.

Figure 2:
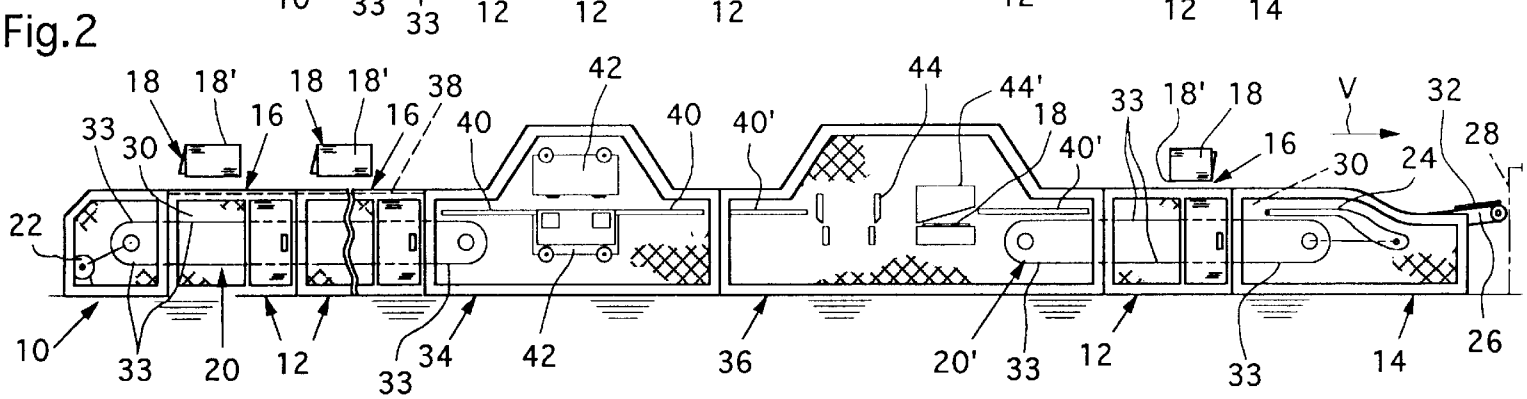
FIG. 2 shows a view of a second embodiment of the processing line according to the invention.

In the case of the processing line which is shown in FIG. 2, two multipurpose modules 12 are arranged one behind the other downstream of the drive module 10. Said multipurpose modules are followed one after the other by a stitching module 34 and a cutting module 36. These are followed by a further multipurpose module 12 and a removal module 14. A conveyor 20 designed in accordance with the conveyor shown in FIG. 1 extends continuously from the drive module 10, through the two multipurpose modules 12, into the stitching module 34. A further conveyor 20' which is likewise of corresponding design, extends from the cutting module 36, through the multipurpose module 12 downstream thereof, into the removal module 14. The drive power for the stitching module 34 and cutting module 36 is taken off from the conveyor 20 in the stitching module 34. The drive for the conveyor 20' is in the cutting module 36 and also serves indirectly, in the same manner as with the processing line according to FIG. 1, for driving the conveying-protrusion chain 24 and the delivery belt 26 of the removal module 14.

The two multipurpose modules 12 which are arranged between the drive module 10 and the stitching module 34 have an attachment with a saddle-like rest 38 which extends in the longitudinal direction of the conveying channel 30 and is located above the latter. Each of these multipurpose modules 12 is assigned a supply location 16 for the successive supply of folded printed products 18 with the open edge, which is located opposite the fold 18', in front.

The stitching module 34 has a saddle-like conveying device 40 which leads past a wire-stitching and/or unsewn-binding head 42 to the downstream end of the stitching module 34. Said conveying device 40 is adjoined, in the cutting module 36, by a further conveying device 40', which leads past a first cutting head 44 and a second cutting head 44' to the downstream end of the cutting module 36. The first cutting head 44 is intended for trimming the leading and trailing edges, as seen in the processing direction V, of the printed products 18 collected in the multipurpose modules 12, and the second cutting head 44' is intended for trimming the edge which is located opposite the fold 18. The multipurpose module 12 which is arranged between the cutting module 36 and the removal module 14 is assigned a further supply location 16, at which folded printed products 18 are supplied with the fold 18' in front.

In the processing line which is shown in FIG. 2, the printed products 18 are processed as follows. The printed product 18 which is deposited in a straddling manner on the saddle-like rest 38 in the first multipurpose module 12 is supplied, by means of the conveyor 20, to the saddle-like rest 38 of the following multipurpose module 12, where a further printed product is deposited on this printed product 18 in a straddling manner. The printed products 18 collected in this way are supplied together, by means of the conveyor 20, to the stitching module 34, where they are supplied to the saddles of the conveying device 40 from the saddle-like rest 38. The wire-stitching and/or unsewn-binding heads 42 stitch and/or bind the collected printed products 18, whereupon the stitched and/or bound printed products are transferred, by means of the conveying device 40, to the further conveying device 40' at the junction with the cutting module 36. Said further conveying device 40' conveys the stitched and/or bound printed products to the two cutting heads 44, 44' and, ultimately, into the active region of the conveyor 20', it being the case that the printed products 18 immediately in front of the first cutting head 44, are rotated through 90° about their fold, running in the processing direction, and, after the second cutting head 44', are rotated through another 90° in the same direction of rotation, with the result that the fold 18' is then located at the bottom. The end region of the cutting module 36, the multipurpose module 12 and the removal module 14, in turn, form a conveying channel 30 which runs in the processing direction V, is open at the top and in which the stitched and/or bound and cut printed products 18 are transported by means of the conveyor 20'. The attachment of the multipurpose module 12 arranged downstream of the cutting module 36 has an opening device for the printed products 18 conveyed in the conveying channel 30, with the result that, at the supply location 16 assigned to said multipurpose module 12, a further printed product 18 can be inserted into the stitched and/or bound and cut printed products. In the same manner as with the processing line which is shown in FIG. 1, the finished or intermediate products 32 formed in this way are supplied to the further-processing station 28.

It goes without saying that further multipurpose modules 12 may be inserted between the drive module 10 and the saddle-stitching module 34 and between the cutting module 36 and removal module 14.

Figure 3:
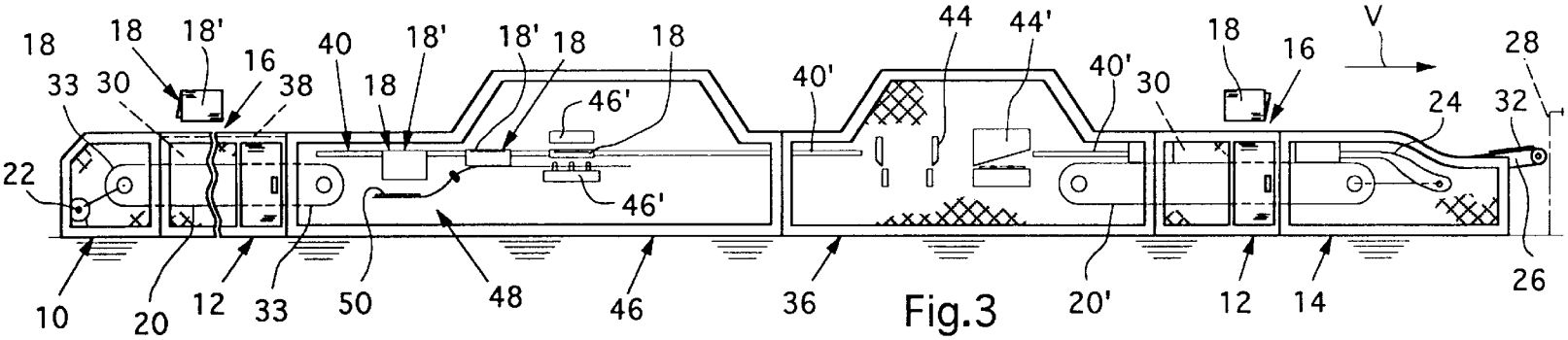
FIG. 3 shows a view of a third embodiment of the processing line according to the invention.

The processing line according to FIG. 3 is similar to that shown in FIG. 2. An essential difference resides in the design of the stitching module, which in this case is designed as a flat-stitching module 46 with a cover-sheet supply 48. As seen in the processing direction V, the drive module 10 is followed by a multipurpose module 12 (or else by a plurality of multipurpose modules 12), a conveyor 20 extending continuously from the drive module 10, through the multipurpose module 12, into the flat-stitching module 46. The multipurpose module 12 is likewise equipped with an attachment having a saddle-like rest 38 on which, at the associated supply location 16, printed products 18 comprising a plurality of folded sheets are deposited one after the other in a straddling manner.

The flat-stitching module 46 likewise has a conveying device 40, which is of saddle-like design and leads past a flat-stitching head 46' to the downstream cutting module 36. The conveying device 40 is intended for rotating, between the conveyor 20 and the flat-stitching head 46', the straddling printed product 18 about its fold 18' running in the processing direction V, for example by means of a rail or of a supporting plate. The cover-sheet supply 48 draws off a cover sheet in each case, for example, from a supply stack 50 and conveys it beneath the rotated printed product 18. The flat-stitching head 46', which may be designed for wire stitching or unsewn binding, stitches or binds together said cover sheet and the sheets of the printed product 18. The stitched or bound products are then supplied to the further conveying device 40' of the cutting module 36, where, as has been described above in conjunction with FIG. 2, the stitched or bound products are trimmed and finished off.

It is also the case with the processing line which is shown in FIG. 3 that, depending on requirements, it is possible for multipurpose modules 12 to be removed or for further multipurpose modules to be added.

Of course, it is conceivable to insert differently constructed modules rather than the saddle-stitching, cutting and flat-stitching modules 34, 36, 46 shown. All that is required is for these differently constructed modules to have an end-side connection configuration which is compatible with the adjacent component modules.

It is thus conceivable for the desired multipurpose modules 12 to be separated out of the processing line which is shown in FIG. 1, for, for example, stitching or cutting modules 34, 36, 46 to be inserted at the desired location and for all the modules to be pushed together again, with the result that they butt directly against one another and are functional again.

It should also be noted that the conveying devices 40, 40' may be designed in a manner similar to the conveyors 20, 20' such that they extend continuously, wholly or in part, through at least these two component modules.

Figure 9:
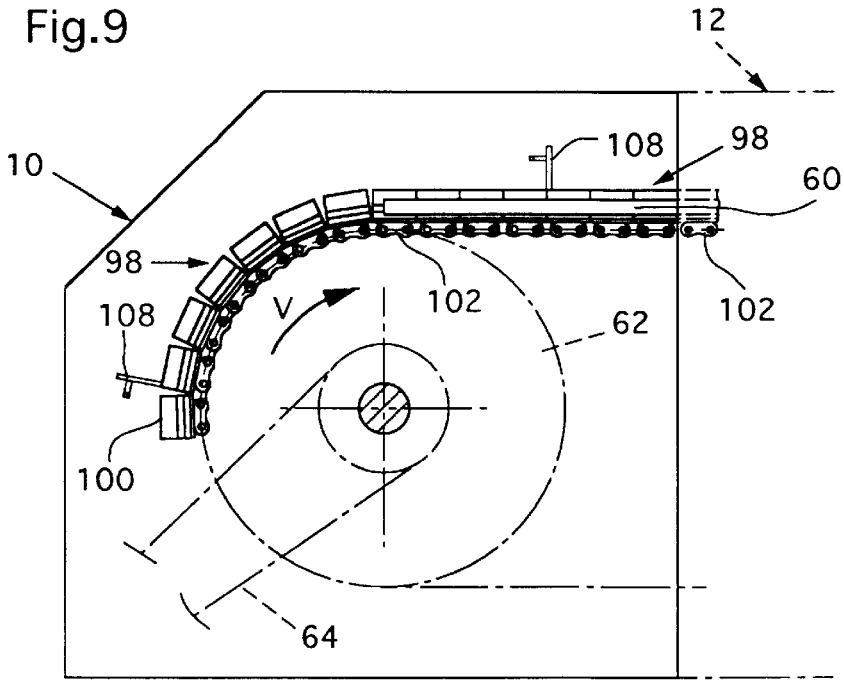
FIG. 9 shows the drive module, which is shown in FIG. 4, in section with conveying elements.
Figure 9:
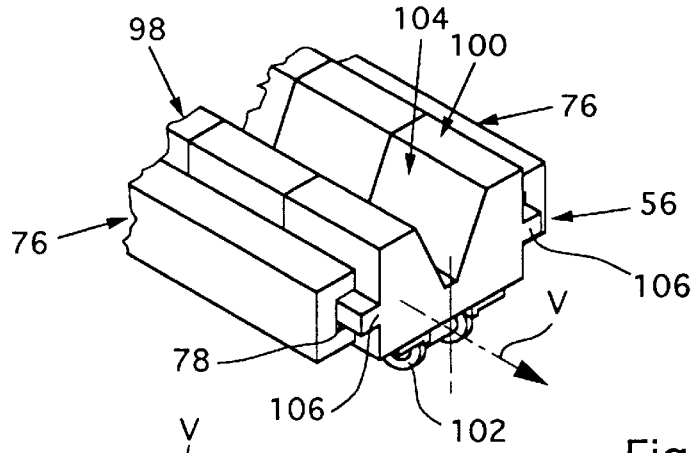

As can be seen from FIG. 4, the drive module 10 has a box-like module housing 54 which is arranged on running rollers 52 and is open on one end side 56. It is possible to attach a further module to said end side 56. Standing on the base 54' of the module housing 54 are two parallel guide plates 58 which, on the mutually facing sides, are each provided with a top guide groove 60 and a bottom guide groove 60'. The top and bottom guide grooves 60, 60' are connected to one another via coaxial connecting grooves (not shown) running along an arc of a circle. Located centrally between the two guide plates 58 is a drive wheel 62 which is mounted rotatably on said guide plates, is arranged coaxially with the connecting grooves, is designed as a chain wheel and is connected, via a chain drive 64 (see FIG. 9), to the drive unit 22, which is likewise arranged in the interior of the module housing 54. Indicated by chain-dotted lines at the corners of the end side 56 are system-connection elements 66 which serve for fastening an adjacent module in a releasable manner.

FIG. 5 shows a multipurpose module 12. It has a module housing 68 which is open at the two end sides 56, as seen in the processing direction V, and of which the cross-sectional dimensions correspond to the cross-sectional dimensions of the housing 54 of the drive module 10. The housing base 68' is likewise supported on the ground via running rollers 52. Fastened on the housing base 68', at intervals in the processing direction V, are transverse supports 70, from which pairs of vertical supports 72 project. Resting on the transverse supports 70 are two bottom guide profiles 74, which extend over the entire length of the multipurpose module 12 and are fastened on the vertical supports 72 by way of their mutually remote sides. Running parallel to the bottom guide profiles 74 are top guide profiles 76, which are likewise fastened on the vertical supports 72 and extend over the entire length of the multipurpose module 12. The bottom guide profiles 74 and top guide profiles 76 are provided, on the mutually facing sides, with rectilinear guide grooves 78 which, when the multipurpose module 12 is attached to the drive module 10, are aligned with the bottom guide grooves 60' and top guide grooves 60 and form a continuous guide therewith.

Parallel side walls project in the upward direction from the housing base 68', and longitudinally running, strip-like coverings 82 are arranged at the top end of said side walls and are directed toward one another. The mutually facing ends of the coverings 82 are adjoined by channel walls 84, which run downward and obliquely toward one another. The channel walls 84 are angled at the bottom and fastened on the top guide profiles 76. The channel walls 84 form the side walls of the conveying channel 30 passing through the entire multipurpose module 12.

The coverings 82 are each provided with a row of holes 86. The attachments 88 mentioned in conjunction with FIGS. 1 to 3, may be positioned on the covering 82, said attachments, for fixing purposes, engaging in holes of the rows of holes 86 by way of downwardly projecting stubs (see also FIG. 12).

The attachment 88 forms a processing channel 90, which is arranged above the conveying channel 30 and is aligned therewith, and runs in the processing direction V.

66, in turn, designates system-connection elements in order to fasten the multipurpose module 12 on, and connect it to, other modules.

It is preferable for the module housing 68, comprising the housing base 68', the two side walls 80, the covering 82 and the channel walls 84, to consist of bent sheet metal which is preferably perforated in the region of the side walls 80. The side walls 80 are provided with doors 92 in order, on the one hand, to allow access into the interior of the module housing 68, and on the hand, to store attachments 88, or components of attachments, therein.

The removal module 14, which is shown in FIG. 6, has a module housing 94 which is open on both end sides and has a housing base 94', supported on running rollers 52, and also has side walls 80', lateral coverings 82' and channel walls 84'. The left-hand channel wall 84', as seen in the processing direction, is twisted, with the result that it passes from its inlet-side slope, which corresponds to that of the corresponding channel wall 84' of multipurpose modules 12, into an at least approximately horizontal position. Said channel wall 84' has a slot-like through-passage which runs more or less in the processing direction V and through which conveying protrusions 24' of the conveying-protrusion chain 24, which has been mentioned in conjunction with FIGS. 1 to 3, project into the conveying channel 30 in order to feed to the delivery belt 26, adjoining the channel wall 84', the finished or intermediate products 32 butting flatly against the channel wall 80'. The delivery belt 26 can be pivoted in the direction of the double arrow in order for it to be possible to adjust its free end in accordance with the inlet of the processing station 28.

A guide plate 96, which is bent in an S-shape as seen in plan view, runs away from the right-hand channel wall 84', as seen in the processing direction V, and this guide plate is intended to bring into abutment against the opposite channel wall 84' printed products 18 which butt against it, in order for it to be possible to convey the printed products further by means of the conveying-protrusion chain 24 and to close open printed products.

For the sake of completeness, it should be mentioned that the removal module 14 has guide plates 58, which are arranged in a mating manner in relation to the drive module 10 and have top guide grooves 60 and bottom guide grooves 60' and a connecting groove, which runs along a circle-arc segment, and a chain wheel, which is arranged between the guide plates 58 and is connected to the conveying-protrusion chain 24 and the delivery belt 26. It is likewise the case that these modules are connected via the system-connection elements 66.

As can be seen from FIGS. 2 and 3, the saddle-stitching module 34 and the flat-stitching module 46 likewise have, on the inlet side, parallel guide plates, which are arranged in a mating manner in relation to the drive module 10 and have a top guide groove and a bottom guide groove which are connected by way of a circle-arc-shaped connecting groove, and a chain wheel, which is arranged between the guide plates, is mounted thereon and is connected to the conveying device 40 and the stitching heads 42, 46' for driving the same. The cutting modules 36 likewise have, on the outlet side, guide plates with top and bottom guide grooves and a circle-segment-like connecting groove, which are arranged in same manner as in the drive module 10. A chain wheel, which is arranged between the guide plates and is mounted thereon, is connected to the conveying devices 40' in order to drive the conveyor 20'.

The conveyors 20, 20' have a multiplicity of conveying elements 98 arranged one behind the other, as are shown in FIGS. 7 to 10. Each conveying element 98 comprises a number of, preferably ten, sliding bodies 100, which are arranged one behind the other on the links of a chain 102 (which is not uninterrupted) . The essentially cuboidal sliding bodies 100 have, on the side which is directed away from the chain 102, a continuous V-like or U-like recess 104, as seen in the longitudinal direction of the chain 102, and guide beads 106 which project laterally on the outer side surfaces and run in the longitudinal direction of the chain 102. The guide elements are arranged between the guide plates 68 and guide profiles 74, 76, the guide beads 106 engaging in the guide grooves 60, 60', 78. Said guide grooves form an uninterrupted guide for the conveying elements 98. The overall length of said guides and the number of conveying elements 98 of the same design are coordinated with one another such that the conveying elements 98 form a continuous, i.e. uninterrupted, row.

The length of the modules, as measured in the processing direction V, with continuous guide grooves, in the present case the multipurpose modules 12, is a whole-numbered multiple of the length L of the conveying elements 98. As can be seen from FIG. 7, for example the multipurpose module 12 is double the length of a conveying element 98. Likewise, the overall groove length in each of the modules, in which deflection takes place from one strand to the other, is coordinated such that, in turn, a whole number of conveying elements 98 are accommodated in the region of the relevant module, in the drive module 10 in the examples shown, in the removal module 14, in the stitching modules 34, 46 and in the cutting module 36.

If, before a module is separated out, the conveying elements 98 are placed such that the separation between two conveying elements 98 is aligned with the end side 56 of the modules, it is possible for the modules to be separated from one another, the relevant number of conveying elements 98 remaining in the guide grooves in each module. Each module thus has a number of conveying elements 98 assigned to it, with the result that the attachment of modules always forms a continuous row of conveying elements 98. The guide section which belongs to a module and has the conveying elements 98 arranged in the guide forms a section 33 of the conveyor 20 or 20'.

Figure 10:
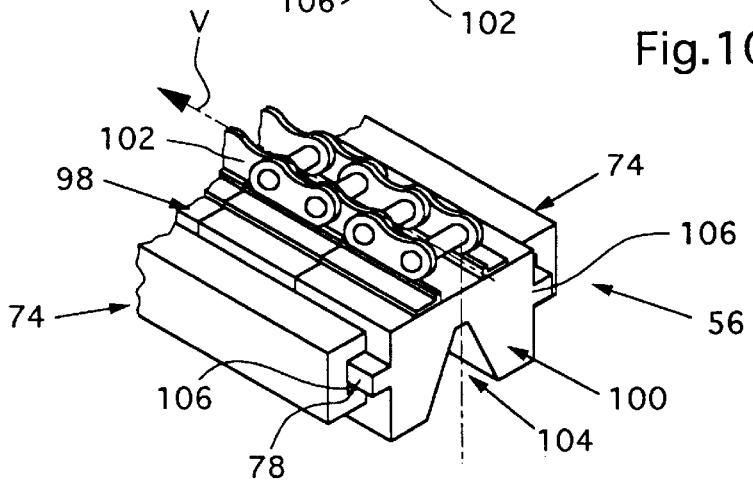
FIG. 10 shows, in perspective, part of the end view of a component module with the guide-path sections and conveying elements in the forward strand and return strand.

FIG. 10 shows the top and bottom guide profiles 74, 76 of a separated multipurpose module 12 with conveying elements 98, arranged therein, in the region adjacent to an end side 56. It is conceivable for the guide profiles 74, 76 to terminate in a state in which they are set back slightly in relation to the end-side plane of the module. The amount by which they are offset, however, is smaller than half the length of a sliding body 100.

The conveying elements 98, located in the region of the conveying channel 30 in each case, form the base of the conveying channel 30, the lateral surfaces of the recess 104 being aligned with the channel walls 84 and 84'. Projecting from the second sliding body 100 from the back, as seen in the processing direction V, in each case, on the side which is directed away from the chain 102, is a carry-along element 108 with a first extension arm 110 and with a second extension arm 110', which is arranged between the first extension arm and the sliding body 100 and is offset to the rear in relation to the latter.

FIG. 7 shows, by chain-dotted lines, printed products 18 which are located in the conveying channel 30 and thus butt against the conveying elements 98 as well as printed products 18 which are arranged, above said conveying elements, in the processing channel 90, which is formed by attachments 88 arranged directly one behind the other. The extension arms 110, which project into the processing channel 90, act on the trailing edge, as seen in the processing direction, of the corresponding printed products in order to transport the same in the processing direction V, whereas the second extension arms 110' act correspondingly on the printed products 18 located in the conveying channel 30.

If an attachment 88 is not followed by any other attachment 88, as seen in the processing direction V, or if two successive attachments 88 form between them a gap which is at least approximately as long as the printed products 18 which are to be processed, printed products 18 which are located in the processing channel 90 are supplied to the bottom conveying channel 30 as they are conveyed out of the relevant attachment 88. In order to compensate for the displacement, seen in the processing direction V, caused by the tilting of the printed product 18, the extension arms 110, 110' are arranged in an offset manner, with the result that in each case the printed product 18 which is to be supplied to the conveying channel 30 is aligned in the conveying direction with the printed product 18 which is already located in the conveying channel 30. The arrangement of attachments 88 thus determines where, in the course of the processing operation, a printed product 18 is supplied from the processing channel 90 to the conveying channel 30.

The conveying elements 98 are driven by means of the drive wheel 62, which is designed as a chain wheel and meshes with the chain 102 of the conveying elements 98. The drive power is transmitted from the conveying element 98 located in the region of the drive wheel 62 to the conveying elements 98 located outside the region of the drive wheel 62 exclusively by pushing contact, in that the individual conveying elements 98 butt against one another on the end sides. The operations for driving the conveying elements 98 of the conveyors 20' and of picking up the movement of the conveying elements 98 by means of chain wheels in the region of the downstream ends of the conveyors 20 and 20' take place in the same manner.

The attachments 88 may be designed differently. Thus, for example, the attachment 88' shown in FIGS. 11 and 12 is provided, in particular, for arranging in the region of the supply locations 16. In an introduction region 112, of which the length, as measured in the processing direction V, is greater than the extent, measured in the same direction, of the printed products 18 which are to be processed, the processing channel 90 has a V-shaped cross section. In an end region 114, which is downstream in relation to the introduction region 112, the cross section of the processing channel 90 corresponds to a narrow U and in a transition region 116, which is located between the introduction region 112 and end region 114, the cross section of the processing channel 90 changes continuously from the cross section of the introduction region 112 to the cross section of the end region 114. The processing channel 90 is formed on the right-hand side, as seen in the processing direction V, by a right-hand processing-channel-wall element 118 which is produced from sheet metal, is bent in a duct-like manner at its bottom end region in order to form the base of the processing channel 90, and has a laterally projecting supporting lug 120 on its top side. On the left-hand side, the processing channel 90 is formed by a left-hand processing-channel-wall element 118', which is likewise produced from sheet metal and is aligned with the duct-like end of the right-hand processing-channel-wall element 118, but terminates at a distance therefrom in order to form, therewith, a slot-like opening 112 which is continuous in the processing direction V. At the top end region, the left-hand processing-channel-wall element 118' likewise has an outwardly directed supporting lug 120. The supporting lugs 120 of the two processing-channel-wall elements 118 and 118' are fastened on a transverse support 124 in each case at the start and at the end of the attachment 88' and, on their bottom side, have stubs 126 which are intended to engage in holes belonging to the rows of holes 86 when the attachment 88' is fitted onto the multipurpose module 12. It goes without saying that the distance between the transverse supports 124 is greater than the length, as measured in the processing direction V, of the printed products 18 which are to be processed, with the result that the latter can be introduced, between the transverse supports 124, into the processing channel 90, and that the distance between the transverse supports 124 and the base of the processing channel 90 is selected such that the printed products 18 which are to be processed can be conveyed through therebetween.

FIG. 11 shows the attachment 88' positioned on a multipurpose module 12. The processing channel 90 is located above the conveying channel 30 of the multipurpose module 12, is aligned therewith and runs in the processing direction V. It is then possible for the extension arms 110 (see FIGS. 7 and 8) to engage, through the opening 122, into the processing channel 90 in order to transport the printed products 18 arranged therein. In FIG. 12, solid lines indicate the attachment 88' before it is placed in position and chain-dotted lines indicate the attachment once it has been placed in position.

For the sake of completeness, it should be mentioned that the attachment 88', which is shown in FIGS. 11 and 12, may be followed by a further attachment having, for example, an opening element in order to open the printed products 18 which are supplied to the attachment 88'. The attachment arranged downstream of the attachment 88' could also have a directing element in order to position against a side wall of the processing channel 90 the printed products which are supplied to the attachment 88', with the result that printed products supplied at a further supply location come to rest alongside the printed product 18 positioned against a wall. It goes without saying that, by virtue of different constructions of attachments and the arrangement thereof in the conveying channel 30, it is possible to provide extremely straightforward adaptation of the processing line to the desired type of processing. For example, it is possible to design attachments in accordance with the processing regions, as are disclosed in the earlier PCT Patent Application published under No. W098/35901, and corresponding U.S. pending application Ser. No. 09/367,465.

It is also conceivable for the conveyors 20, 20' to be replaced by worm conveyors, it being the case that each of the relevant modules is fixedly assigned a section of the conveying worm, or for the conveyors 20, 20' to be designed in accordance with the embodiment disclosed in EP-A-0 458 733 and in the corresponding U.S. Pat. No. 5,158,277, each of the relevant modules being assigned a section of the conveyor.

It is also possible to equip the conveyors 20, 20' not with sliding bodies 100 but with rolling bodies arranged in a guide, as are disclosed, for example, in EP-A-0 387 318 and in the corresponding U.S. Pat. No. 5,074,678 or in the CH Patent Application No. 1997 0221/97. It is also possible for the rolling bodies or sliding bodies 100, which form pressure-exerting bodies, to be arranged loosely in the guide, i.e. such that they are not connected to one another. In this case, the drive wheel acts directly on the pressure-exerting body. As far as the pressure-exerting bodies and the interaction between the drive wheel and pressure-exerting body are concerned, you are referred to CH Patent Application No. 1996 02338/96 as well.

If the sliding or rolling bodies are not connected to one another, separation of the corresponding modules is possible in each case between any two successive sliding or rolling bodies desired. However, separation should always take place between appropriate sliding-body or rolling-body pairs.

It should also be pointed out that, rather than having to form the base of the conveying channel, the conveying elements, as carry-along elements or clamps, may just ensure the advancement of the printed products.

It goes without saying that, by virtue of suitable configuration of the side walls 80' and of the associated guide profiles 74, 76, it is also possible to use bent multipurpose modules 12. This allows free configuration of the processing route, if need be this may also be endless without a return strand. Of course, it is also possible for the connections for power, control and data transmission to be separated in a modular manner.

What is claimed is:

1. A processing line for printed products, having a supply location at which printed products are supplied to the processing line, having at least one further supply location which is arranged downstream of the supply location in the processing direction and is intended for further printed products which are combined in the processing line with printed products which have already been supplied, and at least one processing station for the printed products, a removal location at which the printed products which have been processed and combined to form an intermediate product or end product are guided away from the processing line, and having conveying means for transporting the printed products through the processing line to the removal location, wherein the processing line comprises a number of component modules which can be separated from one another and are arranged directly one behind the other as seen in the processing direction, and a conveyor which is driven by a drive unit and extends continuously, wholly or in part, through at least two of the component modules and can be separated when said component modules are separated, with the result that a section of the conveyor remains in each of these component modules.

2. The processing line as claimed in claim 1, wherein the conveyor has conveying elements which are arranged one behind the other, and, in the event of separation, at least one conveying element remains in each of the component modules.

3. The processing line as claimed in claim 2, wherein the conveying elements are separate from one another and driven in circulation in the processing direction, and wherein the drive power is transmitted from one conveying element to the next by pushing contact.

4. The processing line as claimed in claim 2, wherein all the conveying elements are of the same length as measured in the processing direction, and are guided in a guide path which is uninterrupted when the component modules are arranged one against the other, and the lengths of the sections of the conveying path which are assigned to the component modules correspond to a whole-numbered multiple of the length of one conveying element.

5. The processing line as claimed in claim 1, wherein at least two successive component modules form a continuous conveying channel which is open at the top and in which the printed products supplied to the same are transported by means of the conveyor, and above the conveying channel a processing-channel element which is aligned with said conveying channel and extends in the processing direction is arranged in a removable manner on the associated component module in which conveying elements of the conveyor engage in order to transport printed products supplied to the processing-channel element.

6. The processing line as claimed in claim 5, wherein two processing-channel elements adjoin one another, as seen in the processing direction, and form a continuous processing channel.

7. The processing line as claimed in claim 5, wherein two processing-channel elements following one another in the processing direction leave free between them a through-passage which is open at the bottom and serves for transferring into the bottom conveying channel the printed product which passes out of the upstream processing-channel element.

8. The processing line as claimed in claim 1, wherein a component module designed as a drive module has the drive unit and a section of the conveyor and wherein preferably all the further component modules are arranged downstream of the drive module, as seen in the processing direction.

9. The processing line as claimed in claim 1, wherein a downstream end section of the conveyor, as seen in the processing direction, is arranged in an initial region of a component module which has a conveying device which is arranged downstream of the conveyor and is intended for transporting further the printed products which are supplied by means of the conveyor.

10. The processing line as claimed in claim 1, wherein an upstream end section of the conveyor, as seen in the processing direction, is arranged in an end region of a component module, which has a conveying device which is arranged upstream of the conveyor.

11. A processing line for printed products, having a supply location at which printed products are supplied to the processing line, having at least one further supply location which is arranged downstream of the supply location in the processing direction and is intended for further printed products which are combined in the processing line with printed products which have already been supplied, and a removal location at which the printed products which have been combined to form an intermediate product or end product are guided away from the processing line, and having conveying means for transporting the printed products through the processing line to the removal location, wherein the processing line comprises a number of component modules which can be separated from one another and are arranged directly one behind the other as seen in the processing direction, and a conveyor which is driven by a drive unit and extends continuously, wholly or in part, through at least two of the component modules and can be separated when said component modules are separated, with the result that a section of the conveyor remains in each of these component modules.

12. A processing line for printed products, having a supply location at which printed products are supplied to the processing line, having at least one processing station for the printed products, a removal location at which the printed products which have been processed are guided away from the processing line, and having conveying means for transporting the printed products through the processing line to the removal location, wherein the processing line comprises a number of component modules which can be separated from one another and are arranged directly one behind the other as seen in the processing direction, and a conveyor which is driven by a drive unit and extends continuously, wholly or in part, through at least two of the component modules and can be separated when said component modules are separated, with the result that a section of the conveyor remains in each of these component modules.

* * * * *